US007687997B2

(12) United States Patent
Gaertner et al.

(10) Patent No.: US 7,687,997 B2
(45) Date of Patent: Mar. 30, 2010

(54) UVC/VUV DIELECTRIC BARRIER DISCHARGE LAMP WITH REFLECTOR

(75) Inventors: Georg Friedrich Gaertner, Aachen (DE); Georg Greuel, Roetgen (DE); Thomas Juestel, Witten (DE); Wolfgang Schiene, Wurselen (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 547 days.

(21) Appl. No.: 11/571,837

(22) PCT Filed: Jul. 5, 2005

(86) PCT No.: PCT/IB2005/052235

§ 371 (c)(1), (2), (4) Date: Jan. 9, 2007

(87) PCT Pub. No.: WO2006/006129

PCT Pub. Date: Jan. 19, 2006

(65) Prior Publication Data

US 2008/0061667 A1 Mar. 13, 2008

(30) Foreign Application Priority Data

Jul. 9, 2004 (EP) ..... 04103264

(51) Int. Cl.
*H01J 17/16* (2006.01)
*H01J 61/30* (2006.01)

(52) U.S. Cl. ..... 313/634; 313/234; 313/607; 313/114

(58) Field of Classification Search ..... 313/234, 313/607, 112, 486, 113, 114, 485, 634, 623; 210/748; 445/23
See application file for complete search history.

(56) References Cited

U.S. PATENT DOCUMENTS 4,266,167 A 5/1981 Proud et al.

(Continued)

FOREIGN PATENT DOCUMENTS

DE 10209191 A1 9/2003

(Continued)

OTHER PUBLICATIONS

HV Busch et al; A Short History of the Project Dielectric Barrier Discharges. PFL Report No. 1601-2002.

*Primary Examiner*—Peter J Macchiarolo
*Assistant Examiner*—Glenn Zimmerman

(57) ABSTRACT

The subject of the present invention relates to a high efficiently dielectric barrier discharge (DBD)-lamp for generating and/or emitting a radiation of ultraviolet (UV)-light comprising: a discharge gap (1) being at least partly formed and/or surrounded by at least an inner wall (2) and an at least partly transparent (3), each with an inner surface (2*a*, 3*a*), facing the discharge gap (1) and an outer surface (2*b*, 3*b*) arranged opposite of and directed away from the corresponding inner surface (2*a*, 3*a*), a filling located inside the discharge gap (1), at least two electrical contacting means (4), a first electrical contacting means (4*a*) at the inner wall (2) and a second electrical contacting means (4*b*) at the outer wall (3), and at least one luminescent coating layer (5) arranged at/on and at least partly covering at least a part of the respective wall's inner surface (3*a*), arranged such, that at least a part of the generated UV-light of a certain wavelength range can pass the luminescent coating layer (5) from the discharge gap (1) to the outside of the DBD-lamp, whereby at least one of both walls (2, 3) is at least partly arranged with directing means (6), so that the diffusive radiation is directed in direction through the transparent part of the outer wall (3) with reduced losses due to absorption effects and the like.

10 Claims, 3 Drawing Sheets

U.S. PATENT DOCUMENTS

| | | | | |
|---|---|---|---|---|
| 4,945,290 | A | 7/1990 | Eliasson et al. | |
| 4,983,881 | A * | 1/1991 | Eliasson et al. | 313/607 |
| 5,666,026 | A | 9/1997 | Matsuno et al. | |
| 6,398,970 | B1 | 6/2002 | Justel et al. | |
| 6,837,484 | B2 | 1/2005 | Kingsford et al. | |
| 7,298,077 | B2 * | 11/2007 | Justel et al. | 313/486 |
| 2001/0022499 | A1 * | 9/2001 | Inayoshi | 313/607 |
| 2002/0050780 | A1 | 5/2002 | Juestel et al. | |
| 2003/0048554 | A1 * | 3/2003 | Gillich et al. | 359/883 |
| 2004/0046490 | A1 * | 3/2004 | Doll | 313/485 |
| 2005/0088098 | A1 * | 4/2005 | Reich et al. | 313/634 |

FOREIGN PATENT DOCUMENTS

| | | | |
|---|---|---|---|
| EP | 0642153 | B1 | 4/1997 |
| EP | 1048620 | A1 | 11/2000 |
| EP | 1154461 | A1 | 11/2001 |
| WO | 2003075314 | A1 | 9/2003 |

* cited by examiner

UVC/VUV DIELECTRIC BARRIER DISCHARGE LAMP WITH REFLECTOR

The invention relates to a highly efficient dielectric barrier discharge (DBD)-lamp for generating and/or emitting a radiation of ultraviolet (UV)-light comprising: a discharge gap being at least partly formed and/or surrounded by at least an inner wall and an outer wall, each with an inner surface, facing the discharge gap and an outer surface arranged opposite of and directed away from the corresponding inner surface, whereby at least one of the walls is a dielectric wall and/or one of the walls has an at least partly transparent part, a gaseous filling of the discharge gap, at least two electrical contacting means, a first electrical contacting means associated with the outer wall and a second electrical contacting means associated with the inner wall, and at least one luminescent coating layer arranged at/on and at least partly covering at least a part of the respective wall's inner surface, arranged such, that at least a part of the radiation of a certain wavelength range generated by means of a gas discharge inside the lamp can pass the luminescent coating layer from the discharge gap to the outside of the DBD-lamp.

Such dielectric barrier discharge lamps are generally known and are used in a wide area of applications, where light waves of a certain wavelength have to be generated for a variety of purposes.

Well known dielectric barrier discharge lamps are used for example in flat lamps for liquid crystal display (LCD) backlighting, as cylindrical lamps for photocopiers, and as coaxial lamps for surface and fluid treatment purposes. EP 1048620B1 describes a DBD lamp, which is suited for fluid disinfection and comprises luminescent layers, in this case phosphor layers, which are deposited onto the inner surfaces of the lamp envelope, in this case made of two quartz tubes, which define a discharge volume or a discharge gap. The discharge gap is filled with xenon gas at a certain pressure, which emits a primary radiation as soon as a gas discharge, especially a dielectric barrier discharge, is initiated inside the discharge gap. This primary plasma radiation with an emitting maximum of about 172 nm is transformed by the luminescent layer in a desired wavelength range for example of about 180 nm to about 380 nm. According to the specified applications, this range can be reduced to a range of 180-190 nm in case of the production of ultra pure water or to a range of 200-280 nm if used for disinfections of water, air, surfaces and the like.

The luminescent layer is generally realized by a VUV- or UV-phosphor coating.

In EP 1048620, EP 1154461 and DE 10209191 coaxial dielectric barrier discharge lamps with a suitable phosphor layer coating for generating VUV- or UVC-light are shown.

EP 1048620 B1 shows a device for disinfecting water, comprising a gas discharge lamp including a discharge vessel with walls of a dielectric material, the outer surface of said walls being provided at least with a first electrode, and the discharge vessel containing a xenon-containing gas filling, whereby the walls are provided, at least on a part of the inner surface, with a coating containing a phosphor emitting in the UV-C range, said phosphor containing an activator from the group formed by $Pb^{2+}$, $Bi^{3+}$ and $Pr^{3+}$ in a host lattice.

DE 102 09 191 A1 and EP 1154461 A1 are showing similar constructions or arrangements.

The lamps shown there are typically of a coaxial form consisting of an outer tube and an inner tube melted together on both sides forming an annular discharge gap and having relatively large diameters in respect to the width of the discharge gap. Other types of lamps are or of a dome-shaped form consisting of an outer tube, which is closed on one side, and an inner tube, which is also closed on one side, melted together on the non-closed side forming an annular discharge gap and having relatively large diameters in respect to the width of the discharge gap.

Usually the electrical contact for providing the energy for generating the radiation is realised by electrical contacting means like metallic electrodes, which are applied on the outside or the outer surface of the outer tube and the inside or the inner surface of the inner tube respectively. The outer electrode is usually at least partly transparent, for example in form of a grid, for letting the generated light pass the electrode. Further, the well known DBD-lamps have mostly at the inside of their lamp envelopes a luminescent coating layer.

This well known arrangement has the drawback that due to absorption losses at the inner electrode, the inner dielectric wall and the volume bordered by the inner dielectric wall, in particular in case of multiple reflections inside the lamp, the efficiency of these well known lamps is relatively low.

Therefore it is an object of the present invention to provide a dielectric barrier discharge lamp with minimal absorption losses and a high or highly efficient output of radiation suitable for fluid treatment.

This issue is addressed by a highly efficient dielectric barrier discharge (DBD)-lamp for generating and emitting an ultraviolet radiation comprising: a discharge gap being at least partly formed and/or surrounded by at least an inner wall and an outer wall, each with an inner surface, facing the discharge gap and an outer surface arranged opposite of and directed away from the corresponding inner surface, whereby at least one of the walls is a dielectric wall and/or one of the walls has an at least partly transparent part, a filling located inside the discharge gap, at least two electrical contacting means, a first electrical contacting means associated with the outer wall and a second electrical contacting means associated with the inner wall, and at least one luminescent coating layer arranged at/on and at least partly covering at least a part of the respective wall's inner surface, arranged such, that at least a part of the radiation generated by means of a gas discharge inside the discharge gap can pass the luminescent coating layer from the discharge gap to the surrounding of the DBD-lamp, whereby at least one of both walls is at least partly arranged with directing means, so that the diffusing radiation, which is generated by means of a gas discharge inside the discharge gap and/or emitted by the luminescent coating layer, is directed in a defined direction through the transparent part of at least one of the walls without losses due to absorption effects and the like.

A DBD-lamp according to this invention comprises an outer part and an inner part. The outer part comprises the envelope of the inner part, whereby the inner part comprises the means for generating the radiation and the means for shifting/converting the spectrum of this radiation towards longer wavelengths. The inner part of a DBD-lamp according to this invention is structurally arranged from the inside to the outside as follows:

The heart of the DBD-lamp is the discharge gap with the gas filling. This discharge gap is formed by surrounding walls, whereby at least one wall or a part of this wall is of a dielectric material. These walls are covered at their inner surfaces with a luminescent layer, especially a phosphor layer for converting the radiation generated in the discharge gap. At their outer surfaces the walls have two corresponding electrical contacting means for example arranged as electrodes for providing the energy to stimulate a gas discharge inside the discharge gap and thus for generating a radiation inside the discharge gap, preferably in the VUV-range (<180 nm), which is then converted by the luminescent coating layer into radiation of longer wavelength preferably into the range between 180 nm-400 nm, more preferably into the range between 180 nm-380 nm and most preferably into the range between 180 nm-280 nm.

Electrical contacting means can be any means for transferring electrical energy to the lamp, especially electrodes for example in form of a metallic coating layer or a metallic grid. But nevertheless, other means than electrodes can be used for example if the DBD-lamp is used for fluid or water treatment. In this case the DBD-lamp is at least at one side—the inner wall side or the outer wall side—at least partly surrounded by that water or fluid. The surrounding water or fluid than serves as electrical contacting means, whereby again electrodes transfer the electricity to the water or fluid. It is also possible to generate plasma by non-capacitive means, by means of induction, or even by use of microwaves. So this invention is not limited to electrodes as electrical contacting means. The electrical contacting means are thus associated with the corresponding wall.

Highly efficient or high efficiency in the sense of the invention means, that the DBD-lamp according to the invention has a higher efficiency than the DBD-lamps according to the prior art.

Conventional low pressure-mercury lamps and amalgam lamps for example have high efficiency in the range of 30%-40% but only at low UV-C power density, which means lower than 1 $W_{UV}/cm^2$ down to lower than 0.1 $W_{UV}/cm^2$. Mean pressure-mercury lamps possess a high UV-C power density, which means higher than 1 $W_{UV}/cm^2$ up to more than 10 $W_{UV}/cm^2$ but only a low efficiency in the range of 10%-20%. Compared to these lamps, an optimised DBD-lamp according to the present invention has a medium efficiency in the range of 20%-30% at a UV-C power density between 0.1 $W_{UV}/cm^2$ and 10 $W_{UV}/cm^2$. In combination with the mercury-free aspect, this combination of high efficiency and high UV-C power density makes the DBD-lamp best suitable for the treatment of fluids, preferably water, in particular the treatment of drinking water. Additionally the behaviour of the DBD-lamp is not temperature-sensitive over a wide range and thus the maximum of light output is realized immediately after switching on the DBD lamp, what is generally known as instant light on.

The DBD-lamp according to the invention is arranged for generating and emitting a radiation preferably in the UV range for the treatment of water, air and surfaces, especially for disinfection treatment. Especially for treatment of water, radiation of a wavelength≦280 nm is needed.

For generating UV-light or more generally radiation a discharge volume or a discharge gap is needed, surrounded and/or formed by (a) dielectric wall(s). The material for the dielectric walls is selected from the group of dielectric materials, preferably quartz glass. The material for the dielectric walls have to be arranged such, that the needed radiation passes at least a part of the outer dielectric wall and irradiates the volume or the medium, which surrounds the outer lamp surface. Each of the walls has an inner and an outer surface. The inner surface of each wall is directed to and facing the discharge gap. The distance between the inner surface and the outer surface of one wall defines the wall thickness, which in some special cases can vary. At the outer surfaces or near the outer surfaces the electrical contacting means or electrodes are located. They provide the energy in form of electricity for generating the needed radiation. For applying the radiation, the electrode at or near the outer wall has to be arranged such, that radiation from the inside can pass the electrode. Thus said electrode has to be at least partly transparent, for example in form of a grid, especially when that electrode is arranged adjacent on the outer surface of the outer wall. In that case, in that the electrode is spaced to the outer surface of the outer wall, for example in the case of water treatment, the electrode can be of any suitable material for providing electricity in the corresponding environment.

At least one luminescent coating layer inside the discharge gap is necessary for generating the demanded radiation. This luminescent coating layer usually is located at the inner surface of the wall(s). The luminescent material transforms radiation generated inside the discharge gap by means of a gas discharge into the demanded radiation. The output radiation from the luminescent material and the gas discharge itself is diffuse, that means not all of the generated radiation is directed on its shortest track through the outer wall to the outside. By being directed on its shortest track, the risk of losses is minimized.

Therefore it is a major advantage to arrange a directing means inside the discharge gap. Directing means in the sense of the invention are all means, devices, parts etc. suitable for directing, reflecting, bending, or in general influencing the characteristics of radiation, especially the direction of the radiation. A simple directing means is for example a mirror or a reflecting layer.

This directing means directs the diffusing radiation, emitted by the luminescent coating and the gas discharge itself, into the wanted direction that is preferably the direction through the outer wall, if possible on its shortest track. By this, only one luminescent coating layer only at the inner surface at the outer wall—or on the wall through which the radiation should pass—is necessary. Of course a second luminescent coating layer can be arranged, for example at the inner wall side—or in general at the correspondent wall—, arranged on/at the inner surface of the reflective coating layer—that is the surface facing the gap—or in general of the directing means, so that the reflective coating layer is sandwiched by the luminescent layer and the inner wall. The second luminescent coating layer can also be arranged at the inner surface of the inner wall, whereby in this case the reflective coating layer is located at the outer surface of the inner wall, directly or spaced. By this arrangement, the losses due to absorption at the inner wall (first case) and the area adjacent to the outer surface of the inner wall (second case) can be avoided.

In the case, that only one luminescent coating layer is used at one wall, the inner surface of the correspondent wall only has a reflective coating layer without a luminescent coating layer. The reflective coating layer therefore must be able to reflect the radiation emitted by the gas discharge and the radiation emitted by the luminescent layer. Normally the radiation emitted by the gas discharge has a shorter wavelength (<180 nm) than the radiation emitted by the luminescent layer (>180 nm). Preferably both radiations have to be reflected to the wall, through which the radiation should pass.

The directing means can be any means for directing the radiation into a wanted direction, whereby the directing in a wanted direction can include the avoiding of a directing in an unwanted direction. Preferably the directing means avoids the directing in an unwanted direction.

Therefore it is advantageously, that the directing means are arranged as at least one reflecting coating layer, as a reflective, metallic wall, as a reflective, metallic cylinder, as a reflective, metallic coating, as a reflective, non-metallic wall and the like arranged at least partly at the inner wall and/or at the outer wall. Of course any other suitable reflecting geometry, body and/or means can be used, arranged inside or outside the lamp envelope. The directing means can be arranged at the inner wall, at the outer wall, at the inner wall and partly at the outer wall, and at the outer wall and partly at the inner wall.

By arranging the directing means as a reflecting means like a reflecting coating layer, an easy to realize directing means is realised. In most cases the DBD-lamp is applied, the avoiding of an unwanted direction is needed instead of a directing into a certain direction. So in most or nearly all cases the directing of the radiation through the inner wall to the adjacent areas of the inner wall is unwanted, but also a precise direction through the outer wall to the outer areas of the outer walls can be beneficial in certain cases. For this reason a reflecting coating layer is an advantageously arrangement for realising a suitable and easy to produce directing means. This coating layer can be arranged at the inside and/or the outside of the inner wall. The coating layer can directly or straight be arranged at the respective surface or indirectly or obliquely by means of intermediate layer(s). An intermediate layer can be for example the wall, the luminescent layer, an adhesion layer, a protective layer etc.

The position of the reflective coating layer depends on several parameters for example the direction of the radiation. In cases that the radiation is directed through the outer wall, the position of the reflective coating layer depends on the number and position of the luminescent layer. If two luminescent layers are arranged, one at the inner wall and one at the outer wall, the reflective coating layer can be located at the inner surface of the inner wall, sandwiched between the luminescent layer and the inner wall. In this arrangement, the reflective coating layer can be arranged as metallic reflective coating layer and thus the metallic layer can also be used as electrical contacting means, especially as electrode. The reflective coating layer can at least partly be covered by an additional protective layer. It is also possible to arrange the reflective coating layer as non-metallic reflective coating layer.

Preferably the reflecting means is/are arranged at/on the outer surface of the inner wall, at/on the outer surface of the outer wall, at least partly at/on the outer surface of the inner wall and/or at least partly at/on the outer surface of the outer wall. Again, the reflective coating layer can be arranged as a metallic or as a non-metallic reflective coating layer. If the reflective coating layer is arranged as metallic layer, the metallic reflective coating layer can also be used as electrical contacting means, for example as electrode.

By having directing means it is possible, to use only one luminescent layer, whereby the luminescent layer preferably is arranged at this wall, through which the radiation should pass. In the description the luminescent layer is mainly located at or on the outer wall. But the same effects can be realized analogous for the luminescent layer located at the inner wall.

Preferably the reflecting coating layer is arranged at/on the inner surface of the inner wall, at/on the inner surface of the outer wall, at least partly at/on the inner surface of the inner wall and at least partly at/on the inner surface of the outer wall. This way, a radiation through the inner wall is avoided. The reflecting coating layer is arranged such, that only the wanted or demanded radiation is reflected. Of course the unwanted or not needed radiation can pass the reflecting coating layer, so that the reflecting coating layer is arranged as a filter, whereby the coating layer is only reflecting in regard to the wanted radiation.

It is a further advantage, that the reflective coating layer at the inner surface is of a reflective material preferably selected from the group comprising metallic coatings like Al or Al-alloy coatings and/or highly reflective ultra fine oxide particle coatings such as $AlPO_4$, $YPO_4$, $LaPO_4$, $SiO_2$, MgO, $Al_2O_3$, and/or $MgAl_2O_4$.

More preferably the metallic directing means, metallic coating, metallic cylinder, metallic wall and the like is arranged as an electrical contacting means, preferably in form of an electrode, for simultaneously reflecting radiation and providing electricity.

The coating layer can comprise several coating layers sandwiched as one overall coating layer, whereby the limits between the different coating layers can be stepwise or graduated, that is the different layers could be arranged stepwise or by smooth changeovers.

For preventing the reflecting coating layer at the inside of the discharge gap from possible damages it is advantageously, that the reflecting coating layer is coated by at least one protective layer, preferably an oxide layer, whereby the oxide layer itself can include several oxide layers forming the overall oxide layer. In case of a coating layer comprising several coatings layers being sandwiched to one overall coating layer the coating layer adjacent to the inside of the discharge gap is covered by the protective coating layer. The coating layer is of a protective material selected from the group of highly reflective ultra fine oxide particle coatings like $AlPO_4$, $YPO_4$, $LaPO_4$, $SiO_2$, MgO, $Al_2O_3$, and/or $MgAl_2O_4$. The protective coating layer can be of course integrated into the one overall reflective coating layer as mentioned above. The protective coating layer is not limited for only covering the coating layers. It is also possible, to cover one wall or more precisely one inner surface completely, for example the inner surface of the inner wall.

By covering one wall completely, either with only a reflective layer or with a reflective and protective layer, the material for this wall can differ from that of the other wall, which is usually made of quartz glass, preferably high quality synthetic quartz. By covering said inner wall by a reflective or a reflective and protective coating layer, non-synthetic quartz, glass or even non-transparent materials like standard ceramics or metal can be used as material for the inner wall without disadvantages in performance but with advantages in respect to costs, complexity and the like.

Preferably the reflecting coating layer is of a reflective material preferably selected from the group comprising metallic coatings or highly reflective ultra fine oxide particle coatings such as $SiO_2$, MgO, $Al_2O_3$ or the like. Preferably methods for realizing a coating layer are electrochemical deposition, Electrophoresis, electron beam evaporation, sputtering, and/or CVD (=Chemical Vapor Deposition), precipitation/sedimentation from suspensions (flush-up or flush-down method), centrifugation and printing. A flush-up/flush-down method is a method for bringing up a coating onto a wall by which a suspension is drawn into a body along the correspondent wall, for example a double tube body by means of pressure—that is by depression or vacuum inside the body—and by letting the suspension flow out of said body by increasing the pressure inside the body.

In the case of metallic coatings, the material is selected according to its classification according to its reflecting power at $\lambda$=200 nm. A ranking for suitable materials is listed below:

Al: R=80%
Si: R=67%
Mg: R=65%
Rh: R=50%
Cr: R=38%
Ni: R=30%.

The best suitable material in that case is Al. Of course the reflection power is influenced by other parameters, like the geometry, especially the thickness of the coating layer in the case, the material is coated. The thickness of the reflecting coating layer can increase the reflecting power according to the following formula:

$$n \cdot d = (2m+2) \cdot \lambda/4).$$

For a certain λ the formula gives the corresponding thickness d for the coating layer.

In the case that non-metallic coating, preferably an oxidic coating and most preferably a highly reflective ultra fine oxide particle coating is used. The reflecting coating layer has a structure made up of several grains. For an optimised reflecting, the median diameter of the grains is in a range preferably between 20 nm and 1000 nm, more preferably between 20 nm and 800 nm, and most preferably between 50 nm and 200 nm. The materials for that coating layer, that is diverse oxides, such as $SiO_2$, MgO, $Al_2O_3$ or the like are commonly known, and can be purchased as powder or as ready made slurries.

Of course several reflecting coating layers can be installed adjacent to each other, so that an inhomogeneous coating layer is realized. The inhomogeneous coating layer can be realized by different layers or by a graduation of layers that is by stepwise limited areas, or by areas with a smooth and/or continuously changeover. The reflecting coating layer or in general the directing means can be adjacent to the outer surface of the inner wall or it can be spaced to the outer surface of the inner wall. It is also possible, that the inner dielectric wall is completely replaced by a reflective metallic cylinder, which serves simultaneously as one of the electrical contact means. The arrangement of the walls, the electrodes, and/or the different layers depends mainly on the geometry of the lamp. In general the lamp can be of any form.

Preferably the lamp geometry is selected from the group comprising flat lamp geometry, coaxial lamp geometry, dome lamp geometry, a planar lamp geometry and the like. For industrial purposes coaxial DBD-lamps with relatively large diameters compared to the diameter of the discharge gap or the distance between the inner surfaces of the corresponding inner and outer wall or dome-shaped coaxial lamps are preferably used, to achieve a lamp with a large effective area for environment treatment.

Preferably the material of the luminescent coating layer is arranged such, that radiation of a certain wavelength-range, preferably a wavelength-range from ≧100 nm and ≦400 nm, more preferably from ≧180 nm and ≦380 nm, and most preferably from ≧180 nm and ≦280 nm is generated and can pass the transparent part of the outer wall, whereby the material for the luminescent coating layer is preferably chosen from the group comprising phosphor coatings, preferably UVC- and/or VUV-phosphor coatings and most preferably phosphor coatings like $YPO_4$:Nd, $YPO_4$:Pr, $LuPO_4$:Pr, $LaPO_4$:Pr, $(Y_{1-x-y}Lu_xLa_y)PO_4$:Bi, $(Y_{1-x-y}Lu_xLa_y)PO_4$:Pr, whereby x+y can vary in the range from 0.0 to 0.9. This material and this wavelength-range are most suitable for applications like treatment and/or disinfection of water or other fluids, air or other gaseous streams, and surfaces.

A preferably application of the invention is that the lamp geometry is basically based on two cylindrical bodies arranged such that one cylindrical body envelopes the other cylindrical body. Preferably both bodies are made of quartz glass, but also materials like glass, ceramic, or metal could be used for at least one cylindrical body. Preferably the body which is not of a transparent material for UV-C radiation has a directing means preferably in form of a reflective coating layer.

It is possible that the outer cylindrical body or cylindrical tube is made or at least mainly made of a material of quartz glass, whereby the inner cylindrical tube is mainly made of a metallic material having a reflective coating layer. That means, the invention is also applicable for DBD-lamps with only one dielectric wall forming the discharge gap.

One further advantage of the invention is that the DBD-lamp preferably comprises only one luminescent coating layer at least partly arranged at/on the inner surface of one of the walls and one reflective coating layer at least partly arranged at/on the inner surface of the opposite wall. By reducing the number of luminescent coating layers to only one instead of having two luminescent coating layers at each inner surface of each wall, material can be saved. Additionally the loss due to absorptions or diffuse reflection by that second coating layer at the inner wall can be reduced. On top of this, avoiding the luminescent material at one wall allows a higher operating temperature of this wall assuming that the maximal operating temperature of the luminescent material is lower than the maximal operating temperature of the wall material and of the reflective coating. By having only one luminescent coating layer the lamp efficiency is increased and closer to the relative theoretical possible limit, for the case, the luminescent coating layer is not 100% reflective at the emission wavelength of the luminescent material. In general luminescent coating layers emitting close to the excitation wavelength are not 100% reflective, since the small stokes shift implies a strong overlap of emission and absorption bands and therefore causes strong spectral interactions. In case of only one luminescent coating layer this drawback is alleviated.

To assure, that the coating layers do not separate from the adjacent area (wall, coating layer) one additional adhesion coating layer may sandwiched at least partly between one of the walls and one of the coating layers and/or between two coating layers, whereby the material of that adhesion coating layer is selected from the group of suitable adhesion materials comprising $AlPO_4$, $YPO_4$, $LaPO_4$, MgO, $Al_2O_3$, $MgAl_2O_4$ and/or $SiO_2$.

Part of the invention is a method for producing a highly efficient DBD-lamp comprising steps for arranging all parts together. These steps comprise suitable methods for coating like methods for realising a reflecting coating layer by electrochemical deposition, Electrophoresis, electron beam evaporation, sputtering, and/or CVD (=Chemical Vapor Deposition), precipitation/sedimentation from suspensions (flush-up or flush-down method), centrifugation and printing. Further suitable methods for covering reflection coating layers with at least one protective layer are included.

The DBD-lamp according to the invention can be used in a wide are of applications. Preferably the lamp is used in a system incorporating a lamp according to any of the claims 1 to 10 and being used in one or more of the following applications: fluid and/or surface treatment of hard and/or soft surfaces, preferably cleaning, disinfection and/or purification; liquid disinfection and/or purification, beverage disinfection and/or purification, water disinfection and/or purification, wastewater disinfection and/or purification, drinking water disinfection and/or purification, tap water disinfection and/or purification, production of ultra pure water, gas disinfection and/or purification, air disinfection and/or purification, exhaust gases disinfection and/or purification, cracking and/or removing of components, preferably anorganic and/or organic compounds cleaning of semiconductor surfaces, cracking and/or removing of components from semiconductor surfaces, cleaning and/or disinfection of food, cleaning and/or disinfection of food supplements, cleaning and/or disinfection of pharmaceuticals. One favourable application is the purification or in general the cleansing. This is mainly done by destroying unwanted microorganisms and/or cracking unwanted compounds and the like. By this essential function of that DBD-lamp the above mentioned applications can be easily realised.

These and other aspects of the invention will be apparent from and elucidated with reference to the embodiments described hereinafter.

FIG. 1*a* shows in a longitudinal sectional view an inner part of a DBD-lamp with a reflective coating layer inside the discharge gap instead of a second luminescent coating layer at the inner surface of the inner wall.

FIG. 1*b* shows in a cross sectional view the inner part of FIG. 1*a*.

Figure 1A:
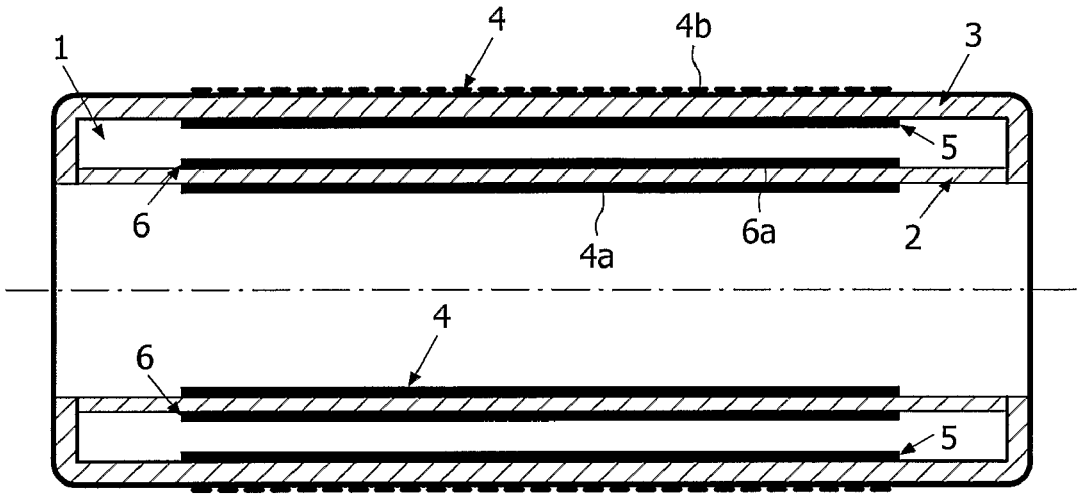
Figure 1B:
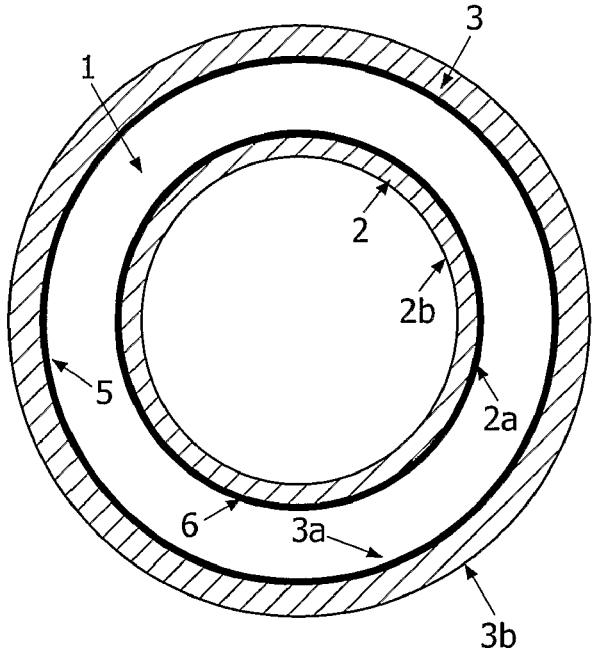

FIGS. 1*a* and 1*b* show a coaxial DBD-lamp with an annular shaped discharge gap 1. FIG. 1*a* shows in a longitudinal sectional view an inner part of a DBD-lamp. FIG. 1*b* shows the same DBD-lamp or the same inner part of the DBD-lamp in a cross-sectional view without the corresponding electrodes. The discharge gap 1 of the DBD-lamp is formed by a dielectric inner wall 2 and a dielectric outer wall 3. In this fig. the discharge gap 1 is formed by an inner lamp tube having a circumferential wall, functioning as the inner wall 2 and an outer lamp tube having a circumferential wall, functioning as the outer wall 3. The lamp tubes are made of quartz glass, which is a dielectric material. The inner wall 2 has an inner surface 2*a* and an outer surface 2*b*. The inner surface 2*a* faces the discharge gap 1 and the outer surface 2*b* is directed in opposite direction. The thickness of the inner wall 2 is defined by the shortest distance between the inner and the outer surface 2*a*, 2*b*. The outer wall 3 has an inner surface 3*a* and an outer surface 3*b* analogue. The inner surface 3*a* corresponds to the inner surface 2*a* of the inner wall 2 and faces the discharge gap 1. The outer surface 3*b* is directed in opposite direction to the inner surface 3*b*. The thickness of the outer wall 3 is defined by the shortest distance between inner surface 3*a* and outer surface 3*b*. The DBD-lamp has two corresponding electrodes 4 arranged at the outer and the inner wall 2, 3. The first electrode is arranged at the outer surface 2*b* of the inner wall 2 and the second electrode 4*b*, shaped as a grid, is arranged at the outer surface 3*b* of the outer wall 3. At the inner surface 3*a* of the inner wall a luminescent coating layer 5 is arranged and/or located. The inner surface 2*a* of the inner wall 2 has no such luminescent coating layer. Instead of this a directing means 6 in form of a reflective coating layer 6*a* is arranged at the inner surface 2*a* of the inner wall 2. In this case the adhesion coating layer is made of ultra fine particles of MgO and functions as a reflecting or directing means 6. Alternatively the reflective coating layer can be replaced by a layer made of ultra fine particles such as $SiO_2$ or $Al_2O_3$. The diameter of the grains, forming that layer is chosen such, that an optimal reflection of the wavelength-range of the generated UV-radiation is realised. Here the filling of the DBD-lamp is a Xe-filling with filling pressures in between 100 mbar and 800 mbar. In this case the wavelength range of the xenon-radiation is about $\lambda$=172 nm. This reflected wavelength-range reaches the luminescent coating layer on the inner side 3*a* of the outer wall 3. The materials for that coating layer, that is diverse oxides, are commonly known, and can be purchased as powder.

The method for forming such a DBD-lamp is mainly described in the following. First the inner and the outer tube are connected one-sided. Afterwards an auxiliary body, for example an auxiliary cylinder is brought between inner wall and outer wall, whereby the diameter of the protective cylinder is slightly larger than the diameter of the inner glass tube. The auxiliary cylinder can be made of any material like metal, glass or quartz. After arranging the auxiliary cylinder, the phosphor coating layer is realised by immersion into another suspension. Finally the protective cylinder is removed. As an alternative to this method it is included in this invention, that both tubes are coated separately before assembling. This second way makes it much easier to apply different coating the tubes. Another embodiment of the invention is shown in FIG. 2.

Figure 2:
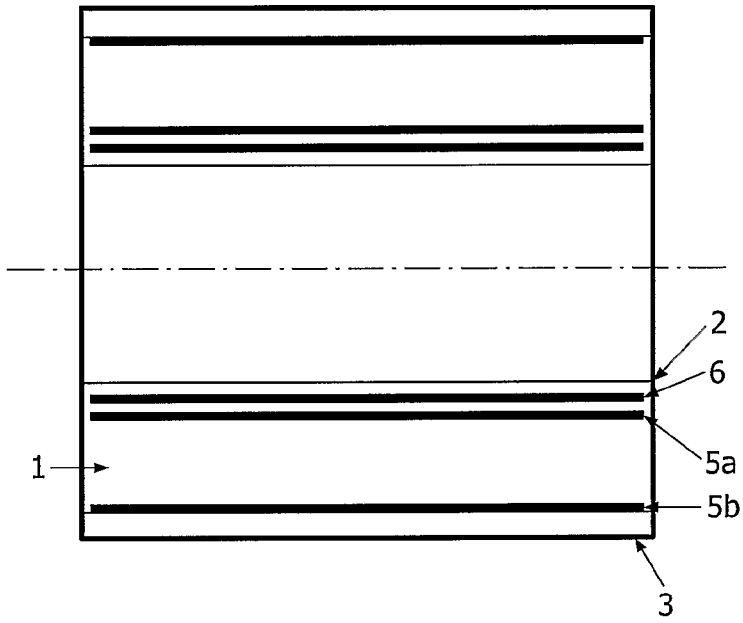
FIG. 2 shows in detail and in a longitudinal sectional view the layer structure of a coaxial DBD-lamp with a discharge gap formed by an inner and an outer quartz tube according to the layer structure according to FIG. 1*a* and FIG. 1*b* with a second luminescent layer on the inside of the inner tube and a reflective layer sandwiched between the inner wall and the luminescent layer.

FIG. 2 shows in detail and in a longitudinal sectional view the layer structure of a coaxial DBD-lamp with a discharge gap 1 formed by an inner and an outer quartz tube according to the layer structure according to FIG. 1*a* and FIG. 1*b* with a second luminescent layer on the inside of the inner tube and a reflective layer sandwiched between the inner wall and the luminescent layer. The DBD-lamp is rotation-symmetrical constructed. The dotted-line represents the rotational axis. The layer structure is described from the inside that is from the rotational axis to the outside. The inner layer is the inner wall 2. Arranged at the inner wall 2 is a reflective coating layer 6, which is covered by a first luminescent coating layer 5*a*, here arranged as a phosphor coating layer. The discharge gap 1 further contains a filling. The second luminescent coating layer 5*b* also here arranged as a phosphor coating layer, is located at the outer wall 3. A third embodiment is shown in FIG. 3.

Figure 3:
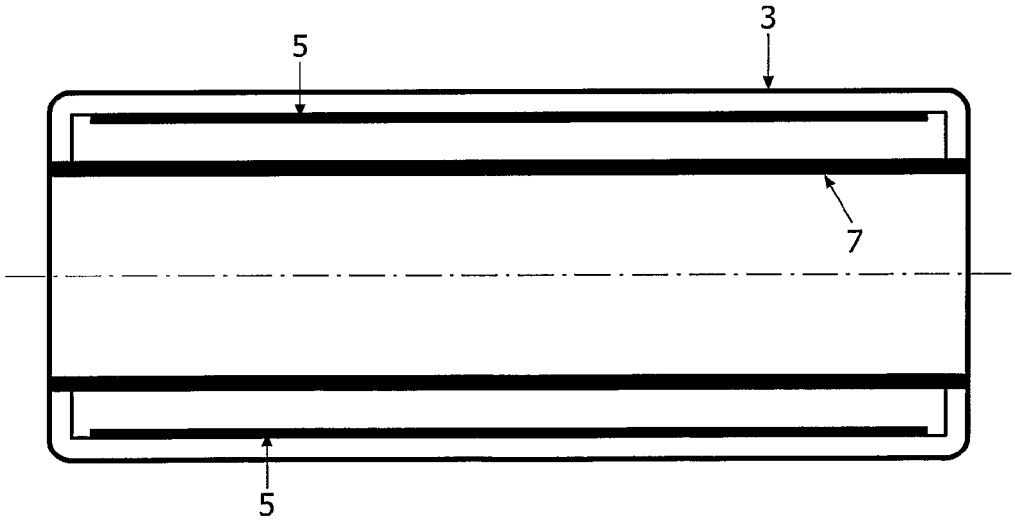
FIG. 3 shows in a schematic way a coaxial DBD-lamp according to the present invention, where the inner quartz tube is replaced by a reflective metallic tube, which serves simultaneously as the inner wall, as a reflector and as one of the electric contacting means.

FIG. 3 shows in a schematic way the inner part of a DBD-lamp according to the present invention with a reflection or directing means formed as metallic cylinder or metallic tube 7, which serves additionally as one of the walls and one of the means for electrical contacting. In FIG. 3 the inner wall is not made of quartz glass but of a metallic material. In this special case the inner glass tube is replaced by an inner metallic cylinder, which is electrically connected to an external power supply (not shown here). The metallic cylinder has either on its inner surface a reflective coating layer basically made of Al or is completely made of Al with a polished surface facing the discharge gap. To prevent sputtering the surface facing the discharge gap is covered with a protective coating layer, in this case of $SiO_2$. In this case, the luminescent coating 5 is only deposited on the inside of the outer wall 3.

Figure 4A:
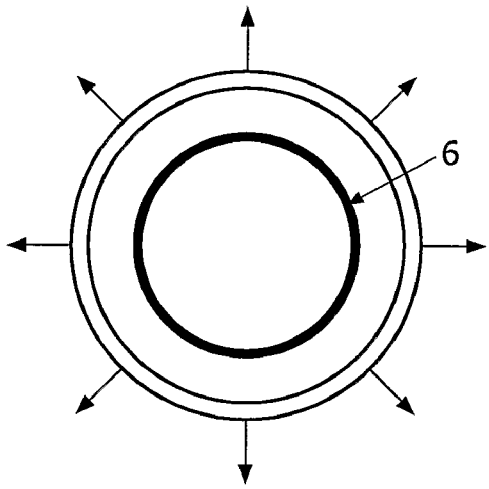
FIG. 4 shows schematically different ways of reflecting the radiation in a well defined direction.
Figure 4B:
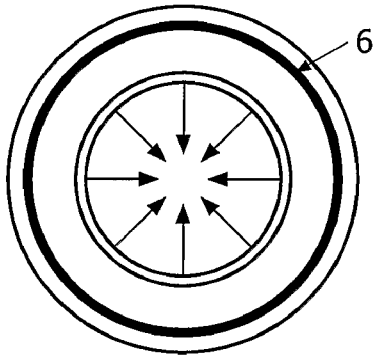
Figure 4C:
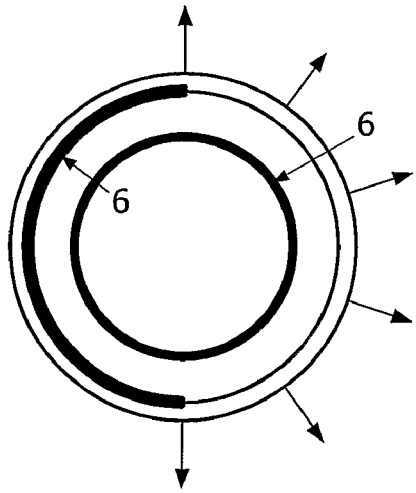

FIG. 4*a* to 4*c* shows schematically different ways of arranging the directing means 6 to emit the radiation (schematically shown as arrows) in a well defined direction: to the outer surrounding of the lamp (FIG. 4*a*), to the inner volume of the lamp (FIG. 4*b*) and to only a certain part of the surrounding of the lamp (FIG. 4*c*). In all three cases, the luminescent layer (not shown here) can be deposited at/on the inside of the inner wall, at/on the inside of the outer wall, at/on both walls. In the case, that a reflective layer and a luminescent coating are applied to one wall, the reflective coating is sandwiched between the luminescent layer and the wall.

LIST OF REFERENCE NUMBERS

1 discharge gap
2 inner wall
2 *a* inner surface (of the inner wall)
2 *b* outer surface (of the inner wall)
3 outer wall
3 *a* inner surface (of the outer wall)
3 *b* outer surface (of the outer wall)
4 electrical contacting mean(s)
4 *a* first electrical contacting mean(s)
4 *b* second electrical contacting mean(s)
5 luminescent coating layer
5 *a* first luminescent coating layer
5 *b* second luminescent coating layer
6 directing/reflecting means
6 *a* reflective coating layer
7 metallic tube (serving as inner wall, reflector and electrode)

The invention claimed is:

1. A dielectric barrier discharge lamp for generating and emitting an ultraviolet radiation comprising:

a cylindrical inner wall having a first inner surface, a first outer surface, a first electrode layer, a first reflective layer, and a first luminescent layer, wherein the first reflective layer is sandwiched between the first luminescent layer and the first inner surface;

a cylindrical outer wall having a second inner surface, a second outer surface, a second electrode layer, a second reflective layer, and a second luminescent layer, wherein the second reflective layer is sandwiched between the second luminescent layer and the second inner surface, wherein the outer wall is transparent and the second reflective layer is absent on a portion of the outer wall;

a cylindrical discharge gap formed between the inner wall and the outer wall, wherein the inner surface of the inner wall and the inner surface of the outer wall are facing the discharge gap, and wherein a filling is located within the discharge gap;

diffusive radiation generated by a gas discharge inside the discharge gap, wherein the diffusive radiation is further emitted by the first and second luminescent coating layers, and wherein the emitted diffusive radiation is directed by reflections from the first and second reflective layers to the outer surrounding of the lamp through the portion of the outer wall for which the second reflective layer is absent.

2. The dielectric barrier discharge lamp of claim 1, wherein the inner wall is a reflective, metallic wall and the first reflective layer is the same as the inner wall.

3. The dielectric barrier discharge lamp of claim 1, wherein the first and second reflective layers are made of a reflective material selected from the group of metallic coatings, Al, Al-alloy, highly reflective ultra fine oxide particle coatings, $SiO_2$, MgO, and $Al_2O_3$.

4. The dielectric barrier discharge lamp of claim 1, wherein the first and second reflective layers are coated by a protective oxide layer.

5. The dielectric barrier discharge lamp of claim 1, wherein the inner wall is transparent and the first reflective layer is on the first outer surface of the inner wall.

6. The dielectric barrier discharge lamp of claim 1, wherein the second reflective layer is on the second outer surface of the outer wall.

7. The dielectric barrier discharge lamp of claim 1, wherein the lamp has a coaxial lamp geometry or a dome lamp geometry.

8. The dielectric barrier discharge lamp of claim 1, wherein the first and second electrode layers are the same as the first and second reflective layers.

9. A system for treating a surface, a liquid, or a gas comprising a dielectric barrier discharge lamp of claim 1.

10. A system for treating a surface, a solid, a liquid, or a gas comprising a dielectric barrier discharge lamp according to claim 1.

* * * * *